United States Patent [19]

Boyd et al.

[11] 4,071,035

[45] Jan. 31, 1978

[54] PYRAMID PIPE

[76] Inventors: Cecil E. Boyd, 2857½ E. Admiral Court, Tulsa, Okla. 74110; Bruce K. McGillvray, 1346 N. 74th E. Ave., Tulsa, Okla. 74115

[21] Appl. No.: 728,597

[22] Filed: Oct. 1, 1976

[51] Int. Cl.[2] ..... A24F 1/14; A24F 1/30

[52] U.S. Cl. ..... 131/173; 131/200

[58] Field of Search ..... 131/173, 200, 211, 216

[56] References Cited

U.S. PATENT DOCUMENTS

| | | | |
|---|---|---|---|
| 2,804,079 | 8/1957 | Wang | 131/173 X |
| 3,805,806 | 4/1974 | Grihalva | 131/173 |
| 3,881,499 | 5/1975 | McFadden et al. | 131/173 |
| 3,882,875 | 5/1975 | Frost | 131/173 |

*Primary Examiner*—Stephen C. Pellegrino

*Attorney, Agent, or Firm*—Head, Johnson & Chafin

[57] ABSTRACT

An apparatus for the double filtering of tobacco smoke by water or other suitable liquid. The apparatus is provided with two vertically arranged chambers, the lower chamber, for carrying the filtering liquid, being in communication with the upper chamber by means of riser tubes. The apparatus includes a tobacco carrying bowl exterior of the apparatus and in communication with the bottom of the lower chamber and including a mouthpiece exterior of the apparatus and in communication with the upper chamber.

10 Claims, 6 Drawing Figures

PYRAMID PIPE

BACKGROUND OF THE INVENTION

1. Field of the Invention

The present invention relates to a smoke filtering apparatus and more particularly to a double aqueous filter apparatus adapted for smoking tobacco in the pipe fashion or cigarette fashion.

2. Description of the Prior Art

It has long been recognized that, in addition to the tar and nicotine problem, one of the harmful effects of smoking relates to high temperature of the smoke when taken into the mouth. Various cooling or heat radiation fins have been utilized to cool the smoke and water cooling devices have been developed. However, heretofore, applicant has no knowledge of an apparatus which fully satisfies, simultaneously, the effective filtering of tar and nicotine while removing the heat from the smoke prior to taking same into the mouth.

SUMMARY OF THE INVENTION

The present invention is a smoking apparatus which is particularly designed and constructed to provide effective double filtering of the smoke by water or other suitable liquid and wherein sufficient contact with the liquid and distance of travel serves to cool the smoke and thereby reduce any harmful effects thereof.

The smoking apparatus may be of various sizes and shapes but must contain two separate chambers with one of the chambers being positioned at a higher elevation or above the other.

The upper chamber is in communication with the lower chamber by use of a plurality of riser tubes which extend from the bottom of the upper chamber downwardly to near the bottom of the lower chamber.

A tobacco holding container or bowl is located exterior of the apparatus and at a higher elevation than the lower chamber and is connected by a tube or the like in open communication with the bottom of the lower chamber. The tobacco holding container may take the form of a cigarette holder when so desired.

A mouthpiece is located exterior of the apparatus and is connected in open communication with the upper part of the upper chamber. The upper chamber is also provided with a relief bore to the atmosphere which may be selectively opened or closed and is hereinafter referred to as a carburetor bore.

A small smoke escape orifice is provided between the top of the lower chamber and the upper chamber for a purpose that will be hereinafter set forth.

The first step in utilizing the smoking apparatus is to substantially fill the lower chamber with water and the tobacco bowl with the desired mixture. Then, close the carburetor bore and draw on the mouthpiece. This will produce a vacuum in the upper chamber, and simultaneously a lighted match or other ignition device is held in contact with the tobacco mixture.

The vacuum in the upper chamber causes a pressure drop between the upper and lower chambers which is satisfied by the movement of water up the riser tubes. The void created in the lower chamber is then filled with smoke from the tobacco bowl. Since the smoke enters the lower chamber at the bottom, it must bubble up through the water toward the upper portion of the lower chamber thereby filtering and cooling the smoke.

After the water in the lower chamber has moved up into the upper chamber through the riser tubes, then the smoke in the lower chamber along with the smoke being brought in from the tobacco bowl starts to move up the riser tubes and bubbles up through the water in the upper chamber which provides a second filtering and cooling of the smoke.

When the draw is released from the mouthpiece, the water starts running down the risers which refills the lower chamber thereby driving the smoke left in the lower chamber through the relief orifice into the upper chamber.

Drawing on the mouthpiece may resume to initiate the process again or the carburetor hole may be released to clear the upper chamber.

There have been recent allegations of unknown powers or forces attributed to pyramid shaped structures. Applicants, while realizing that taste is a subjective sense, believe the taste of the smoke is improved when the top of the upper chamber is in the shape of a pyramid.

DESCRIPTION OF THE DRAWINGS

Other and further advantageous features of the present invention will hereinafter appear in connection with a detailed description of the drawings in which.

DESCRIPTION OF THE PREFERRED EMBODIMENTS

Figure 1:
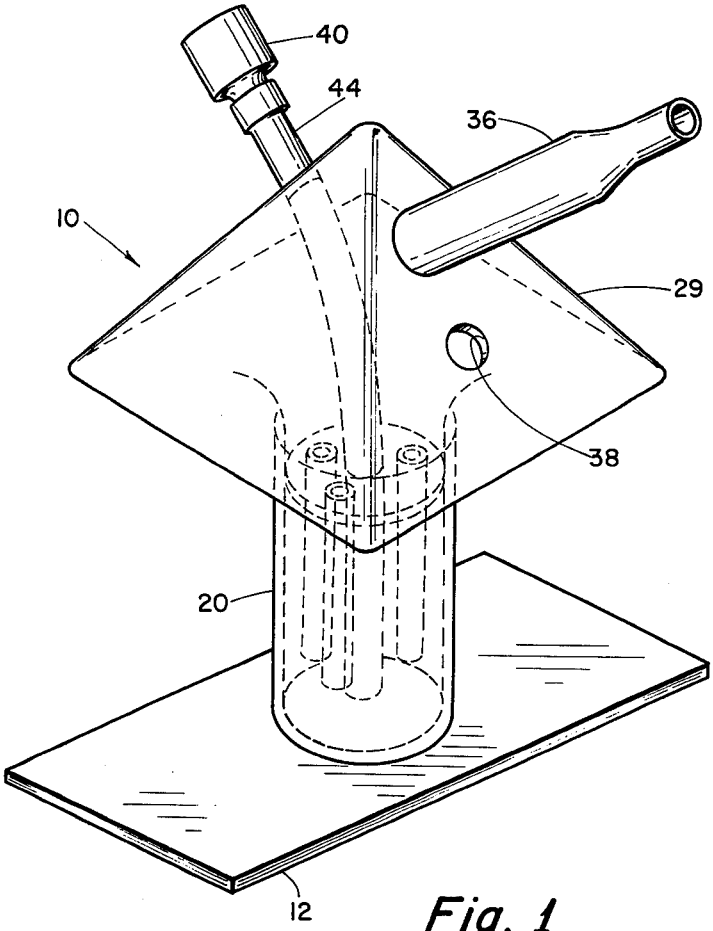
FIG. 1 is a prospective view of a smoking apparatus embodying the invention.

Referring to the drawings in detail, reference character 10 generally indicates a double chamber smoke filtering apparatus comprising a flat platform 12 to lend stability to the device. The apparatus 10 comprises a container 14 which is separated into two substantially closed chambers 16 and 18. The chamber 16 is formed by a cylindrical lower container segment 20 which is attached at its lower end to the platform 12, the upper end thereof being open. The upper chamber 18 is formed by a substantially closed container 22 which has the lower portion 24 thereof shaped to conform to the upper open end of the lower container for sealingly nesting therein. The bottom of floor 26 of container 22 thereby serves as a partition between the upper chamber 18 and the lower chamber 16. The top portion 29 of the upper container 22 is in the shape of a pyramid for a purpose that will be hereinafter set forth.

The floor 26 of the upper container 22 is provided with a plurality of apertures 28 for receiving the upper end of a plurality of vertically disposed riser tubes 30. The riser tubes 30 extend from the apertures 28 downwardly into the lower chamber 16 and terminate above the bottom of said lower chamber 16. Also provided in the platform 26 is at least one small orifice 32 sufficient to allow gas to transfer from the lower chamber 16 to the upper chamber 18 for a purpose that will be hereinafter set forth.

The upper container 22 is also provided with a bore 34 through the upper portion thereof for receiving a mouthpiece tube 36 therein. The mouthpiece tube 36 provides open communication from the chamber 18 to the atmosphere. A second bore, hereinafter called a carburetor bore 38 is provided in the pyramid portion 29 of the upper container 22 also for purposes that will be hereinafter set forth.

Figure 3:
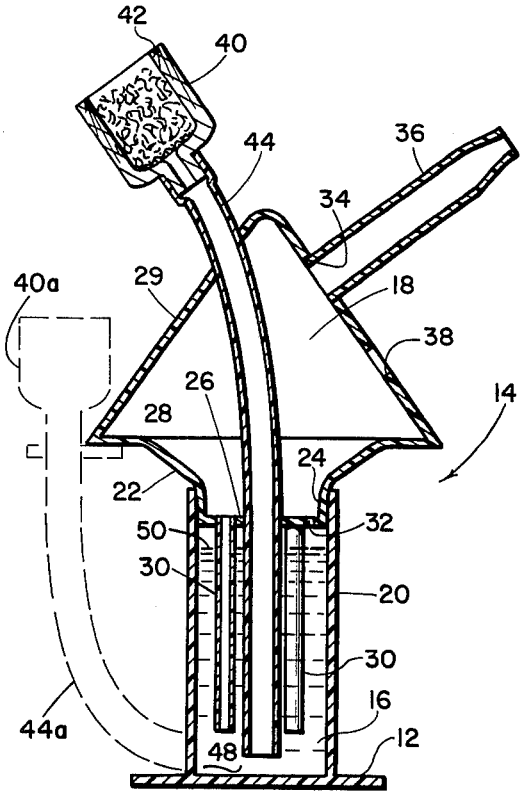
FIG. 3 is a side elevational sectional view of the apparatus loaded with tobacco and water.

A tobacco holding means 40 is provided for holding a supply of tobacco 42 therein for burning. The holder 40 is connected by means of a tube 44 to the lower portion of the lower chamber 16 and terminates at a point between the bottom of the chamber 16 and the lower ends of the riser tubes 30. The design for this particular embodiment shows the tube 44 passing through the walls of the upper chamber 18, through the partition floor 26 and into the lower chamber. However, it is noted, as shown in FIG. 3 by the dashed lines, that the bowl may be situated anywhere outside the apparatus and connected by tube 44A into the lower portion of the container 16. The only requirement is that the bowl 40 be disposed at a higher altitude or elevation than the partition 26 to prevent the flow of liquid into the bowl.

Figure 2:
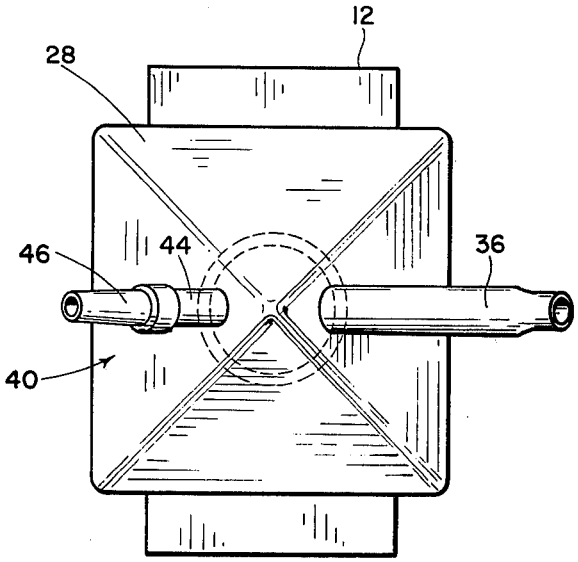
FIG. 2 is a top plan view of the aperture of FIG. 1.

Referring to FIG. 2, the tobacco container 40 is in the form of a cigarette holder 46.

In order to operate the tobacco smoking apparatus 10, the tobacco container or bowl 40 is filled with a charge of smoking material 42 as shown in FIG. 3. Before the smoking operation begins, the entire upper container 22 may be lifted off of the lower container whereby the lower container is filled with water or other suitable filtering liquid 48 up to a predetermined level 50. It is noted that part of the water will rise up into the riser tubes 30 and may, according to the packing level of tobacco in the bowl 40 rise up into the tube 44 thereof.

Figure 4:
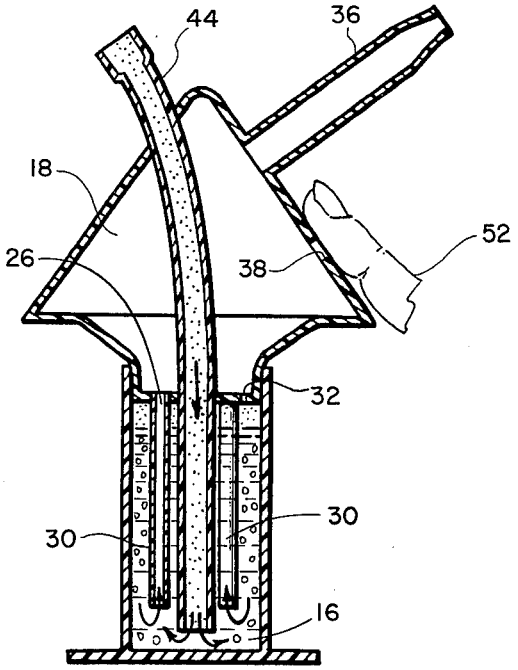
FIG. 4 is the view of FIG. 3 depicting the first step of the smoking process.
Figure 5:
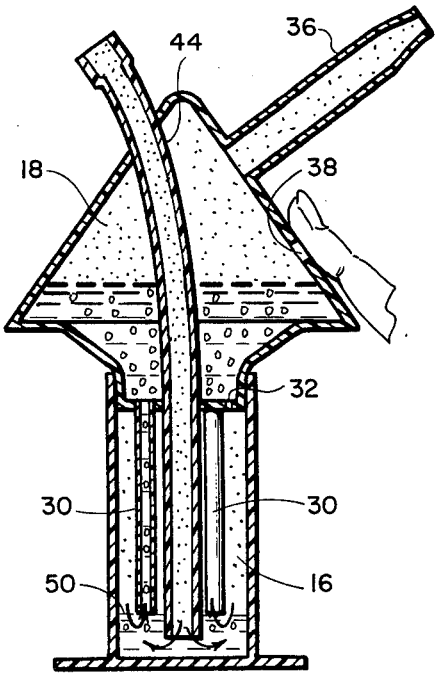
FIG. 5 is the view of FIG. 3 depicting the second step of the smoking process.

The first step of the smoking operation is to place the mouth on the mouthpiece 36 and a finger or other closure means 52 over the carburetor aperture 38 as shown in FIG. 4. When a suction or draw is made on the mouthpiece 36, a vacuum is formed in the upper chamber 18 thereby creating a pressure drop across the partition or floor 26 of the upper chamber. Equalization of this pressure drop is accomplished by the drawing of smoke from the bowl 40 downwardly through the tube or passageway 44 into the bottom of the lower chamber 16. The smoke or gas mixture will bubble up through the liquid or filtering device as shown in FIG. 4 to the upper portion of the lower chamber 16. Simultaneously, the water level will increase in the riser tubes as water tends to flow upward through the riser tubes into the lower portion of the upper chamber 18. As suction is continued on the mouthpiece 36, the lower chamber water supply will gradually feed up through the riser tubes 30 and into the lower portion of the upper chamber 18. When the water level 50 in the lower chamber reaches a level corresponding to the lower ends of the riser tubes 30, smoke contained in the lower chamber 16 along with new smoke being brought into the lower chamber 16 via the tube 44, will pass into the riser tubes and upwardly into the chamber 18. As the smoke enters the chamber 18, it will again bubble through the liquid contained therein, which will tend to filter the smoke a second time and to further reduce the temperature of the smoke.

Figure 6:
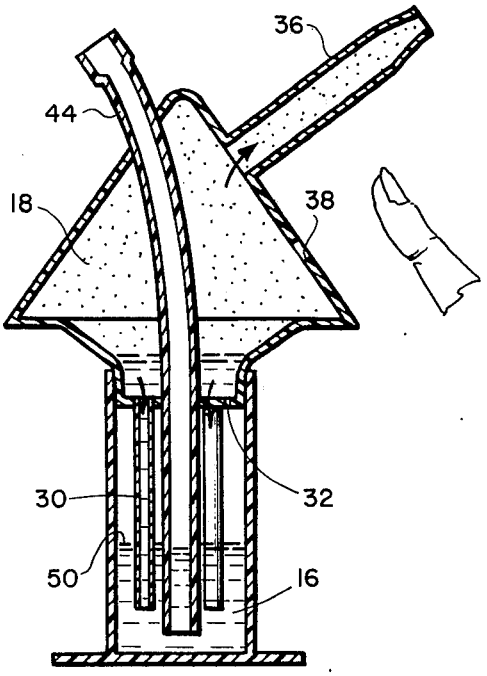
FIG. 6 is the view of FIG. 3 depicting the third step of the smoking process.

At this point, the finger may be released from the carburetor hole 38 as shown in FIG. 6 whereby the water or liquid in the upper chamber 18 will pass down the riser tubes 30 by gravity flow and into the lower chamber thereby raising the water level 50 in the lower chamber. Smoke contained in the upper portion of the lower chamber 16 is allowed to pass into the upper chamber through the small orifice 32 hereinbefore described. It is noted that the orifice 32 may be provided by a small bore as shown in the figures. However, this passageway may also be provided by allowing a higher tolerance between the smoke inlet tube 44 when it passes through the floor or partition 26. After the water has emptied from the chamber 18 into the lower chamber 16, the smoke contained in the upper chamber may be withdrawn through the mouthpiece 36 thereby clearing the upper chamber.

It is noted that all of the smoke coming from the bowl 40 has been filtered at least two times through the water. The first time of filtering occurred as the lower chamber was being emptied through the riser tubes into the lower chamber. The second filtering occurred after the lower chamber is substantially emptied and the smoke passed up through the riser tubes and bubbles up through the liquid a second time into the upper chamber 18. During this operation, some smoke was necessarily drawn into the lower chamber through the tube 44. However, since the lower end of the tube 44 is at a lower level than the bottom of the riser tubes 30 some bubbling or filtering action occurs at that point. Thirdly, when the water was being allowed to empty back into the lower chamber 16 from the upper chamber 18, the smoke still present in the upper part of the lower chamber 16 is allowed to pass through the orifice 32 and again bubble through the water that is being emptied out of the upper chamber.

Further, in the embodiment as shown, by passing the tube 44 through the upper chamber and the lower chamber in order to position the end in the lower portion of the lower chamber 18, a small amount of heat exchange transfer takes place as the smoke is being brought into the container. Although the device as shown in the dashed lines of FIG. 3 would be operable, this heat exchange transfer would not take place in the embodiment as shown.

From the foregoing, it is apparent that the present invention provides a smoking apparatus whereby the smoke is filtered through water or other filtering liquid twice before it is taken through the mouthpiece for consumption. This filtering action not only provides for the removal of tars and nicotines from the smoke itself but also provides for the cooling of the smoke to prevent harmful burn effects to the mouth and throat of the tobacco user.

Whereas, the present invention has been described in particular relation to the drawings attached hereto, it is obvious that other and further modifications apart from those shown are suggested herein may be made within the spirit and scope of the invention.

What is claimed is:

1. A double chamber smoke filtering apparatus comprising:

a. a first chamber for receiving a filtering liquid therein;

b. a second chamber disposed above the first chamber;

c. a plurality of fluid riser tubes connecting the bottom of the second chamber with the lower portion of the first chamber;

d. tobacco carrying means exterior of the chambers and including smoke passageway means operably connecting the tobacco carrying means in open communication with the bottom of the lower chamber below the riser tubes;

e. a mouthpiece passageway means exterior of the chambers and operably connected in communication with the second chamber;

f. a small smoke escape orifice disposed between the first and second chambers providing communication between the top of the first chamber and the bottom of the second chamber.

2. A smoke filtering apparatus as set forth in claim 1 and including carburetor aperture providing communication between the second chamber and the exterior of the apparatus, capable of selective opening and closing thereof.

3. A smoke filtering apparatus as set forth in claim 1 wherein the second chamber is of a pyramid shape.

4. A smoke filtering apparatus as set forth in claim 1 wherein the second chamber is a closed container having a bottom tubular portion and wherein the first chamber is an open topped container having an upper tubular portion shaped for sealingly receiving the bottom tubular portion of the second container therein and wherein a plurality of bores are provided in a bottom of the upper closed container for receiving and supporting the upper ends of the plurality of riser tubes therein, and wherein the small orifice is provided through the bottom of the upper closed compartment.

5. A smoke filtering apparatus as set forth in claim 1 wherein the tobacco carrying means comprises a tobacco bowl.

6. A smoke filtering apparatus as set forth in claim 1 wherein the tobacco carrying means comprises a cigarette holder.

7. A smoke filtering apparatus as set forth in claim 1 wherein the smoke passageway means is a tube having one end thereof connected to the tobacco carrying means, the opposite end thereof being sealingly passed through the second chamber and into the first chamber and terminating between the lower ends of the riser tubes and the bottom of the first chamber.

8. A smoke filtering apparatus comprising;

a. a closed container;

b. a horizontal partition dividing the closed container into upper and lower chambers;

c. a plurality of vertically disposed riser tubes, the upper ends thereof extending through the partition in open communication with the upper chamber, the lower ends thereof extending downwardly into the lower chamber and terminating in the lower portion of said lower chamber;

d. a small smoke escape orifice provided through the partition communicating between the upper and lower chambers;

e. mouthpiece means connected through the container and in communication with the upper chamber;

f. carburetor bore provided through the container and in communication with the upper chamber and capable of being selectably opened or closed;

g. tobacco carrying means disposed exterior of the container, smoke passageway means connected to the tobacco carrying means at one end thereof, the opposite end thereof passing through the container and in communication with the lower portion of the lower chamber between the lower end of the riser tubes and the bottom of said lower chamber.

9. A smoke filtering apparatus as set forth in claim 8 wherein the top of the container is pyramid shaped.

10. A double chamber smoke filtering apparatus comprising;

a. a first chamber for receiving a filtering liquid wherein;

b. a second chamber disposed above the first chamber;

c. at least one fluid riser tube connecting the bottom of the second chamber with the lower portion of the first chamber;

d. tobacco carrying means exterior of the chambers and including smoke passageway means operably connecting the tobacco carrying means in open communication with the bottom of the lower chamber below the riser tubes;

e. a mouthpiece passageway means exterior of the chambers and operably connected in communication with the second chamber;

f. a small smoke escape orifice disposed between the first and second chambers providing communication between the top of the first chamber and the bottom of the second chamber.

* * * * *